United States Patent [19]

Healey, Jr.

[11] 3,979,709

[45] Sept. 7, 1976

[54] ELECTRIC FUSE HAVING A MULTIPLY CASING OF A SYNTHETIC - RESIN GLASS-CLOTH LAMINATE

[75] Inventor: Daniel P. Healey, Jr., Merrimacport, Mass.

[73] Assignee: The Chase-Shawmut Company, Newburyport, Mass.

[22] Filed: May 22, 1975

[21] Appl. No.: 579,972

[52] U.S. Cl. ..... 337/186; 337/414; 337/415

[51] Int. Cl.[2] ..... H01H 85/02

[58] Field of Search ..... 337/158, 186, 414, 415

[56] References Cited

UNITED STATES PATENTS

| | | | |
|---|---|---|---|
| 3,723,930 | 3/1973 | Koch | 337/158 |
| 3,750,075 | 7/1973 | Cooper | 337/158 |
| 3,911,385 | 10/1975 | Blewitt et al. | 337/186 X |

*Primary Examiner*—George Harris
*Attorney, Agent, or Firm*—Erwin Salzer

[57] ABSTRACT

An electric fuse comprises a fusible element, arc-quenching means surrounding said fusible element, a casing of synthetic-resin-glass-cloth laminate housing said fusible element and said arc-quenching means, and a pair of terminal elements arranged at the ends of said casing and conductively interconnected by said fusible element. Said casing includes a plurality of plies, at least an outermost ply and an innermost ply, both formed by woven glass fiber fabric and at least one intermediate ply formed by a glass fiber mat having non-uniformly oriented fibers. The outermost ply and the innermost ply each form an overlap extending substantially in a direction longitudinally of said casing. Both overlaps are angularly displaced. The casing further includes a thermosetting resin integrating said outermost ply, said innermost ply and said intermediate ply into a laminate. The glass fiber density of said laminate is locally increased at the region of said overlap of said outermost ply, and at the region of said overlap of said innermost ply, to such an extent that the wall thickness of said casing is virtually uniform along the entire periphery or perimeter thereof.

Further disclosed are modifications of the above tubular casing structure having a larger number of plies than three.

22 Claims, 18 Drawing Figures

ELECTRIC FUSE HAVING A MULTIPLY CASING OF A SYNTHETIC - RESIN GLASS-CLOTH LAMINATE

BACKGROUND OF THE INVENTION

Tubular materials intended to be used as fuse casings, or fuse tubes, must meet a large number of requirements. They must be able to withstand the high pressures generated inside of fuses when blowing, to withstand without ageing significantly the temperatures prevailing in fuses while the latter are carrying current, be heat-shock resistant, be dimensionally stable, substantially non-tracking, cost-effective, etc. Some of the requirements under consideration can be met easily. There are, however, very few tubular materials which meet most or all requirements for a large number of different fuse casing applications, and the cost-effectiveness of these few materials is quite small.

There are fuses whose casings are of ceramic materials and others whose casings are substantially of organic materials, particularly synthetic resins. Synthetic resin casings are generally reinforced by glass fibers in various forms. Among the synthetic resin casings those which are reinforced by convolutely wound glass cloth have probably found the widest acceptance, and electric fuses having filament wound casings are also in use.

The prime object of this invention is to provide fuses, and in particular current-limiting fuses, having casings of glass fiber reinforced synthetic resins that are more cost-effective than prior art fuses of this description.

Another object of this invention is to provide fuses whose casings consist of sections of pultruded tubing. This object is predicated on the fact that the pultrusion process as such is cost-effective, and that it can readily be carried out with synthetic resins that do not evolve gases when heated that are detrimental to arc extinction.

Prior art pultruded tubing lacks the mechanical properties required and/or desirable for casings of electric fuses. It is, therefore, a further object of this invention to provide novel fuse casing structures that lend themselves to be manufactured by the pultrusion process.

Still another object of the invention is to provide fuses, in particular current-limiting fuses, having composite casings particularly designed to maximize the impact strength, or dynamic strength, thereof.

Other objects of this invention will be apparent from what follows.

A current-limiting fuse may be defined as a fuse capable of interrupting the solid metallic current path formed by the fusible element before the current rises to its available peak value, and capable of generating such arc voltages that the current decreases rapidly to zero from the peak value it had reached. This invention refers particularly to current-limiting fuses. By precluding a short-circuit current from reaching the peak value it is capable of reaching, current-limiting fuses greatly reduce stresses of an electromagnetic, or electrodynamic, or thermal nature upon any piece of equipment which is arranged in circuits protected by such fuses. This stress reduction applies not only to miscellaneous electric equipment but also in regard to the stresses to which the casings of current-limiting fuses are subject.

Fusion of the fusible elements of current-limiting fuses and their consequent vaporization is in the nature of an explosion involving generation of relatively high pressures at a relatively high rate. The pressure waves generated at the arc paths in current-limiting fuses are propagated through the pulverulent arc-quenching filler thereof — which is generally quartz sand — and act upon the inner side of the walls of the casings of the fuses. Arc-quenching fillers dampen, or attenuate, the intensity of the pressure waves, but their magnitude is still, or may be still, large and tend to cause bursting of casings of fuses. This must, of course, be prevented. It can be prevented by increasing the wall thickness of casings, which may result in intolerable dimensions. This crude approach to the problem of designing fuse casings is also conducive to expensive casing materials.

The forces which mechanical structures can withstand without fracturing depend upon the duration of the action of the forces. Assuming that a given force $p$ maintained during a given period of time T is capable of fracturing a given mechanical structure; that mechanical structure may withstand a much larger force P if applied during a much shorter time $t$ ($p < P$; $t < T$). This explains why a piece of electric equipment rated to withstand the forces $k$ exerted by a given short-circuit current $i$ during one second can withstand much higher forces K exerted by a much larger let-through current I of current-limiting fuses whose duration is in the order of milliseconds $t(i < I; k < K\ t < 1$ sec.). Thus the fact that the pressure waves of exploding fusible elements acting upon the casings of current-limiting fuses have durations in the order of milliseconds may be utilized to design relatively inexpensive casings for such fuses, i.e. casings which would be mechanically destroyed if the pressure wave were of relatively longer duration, e.g. lasted for 1 second. The maximal force which a given structure may withstand if that force is applied but once and if the duration of that force is very short, e.g. less than 5 milliseconds, may be referred-to as the dynamic strength, or impact strength, of the structure.

The present invention provides novel tubing materials specially evolved to comply with the dynamic or impact strength requirements of casings of current-limiting fuses, and evolved to take advantage of the fact that the casings of fuses are only once in their life, and only for very short durations, subject to very high pressures.

In order to fracture a given structure by an impulse load a predetermined minimum amount of energy is required. This predetermined amount of energy applied by almost instantaneous or shock loading is a measure for the dynamic strength, or impact strength, required for the casings of fuses, in particular current-limiting fuses. Any tubular material intended to be used as casing material for such fuses ought to be constructed to have a high dynamic strength, or impact strength, rather than to be capable of containing high pressures for prolonged periods of time.

Materials which are resilient or ductile tend to be capable of absorbing larger amounts of energy under impact loading conditions than materials which are brittle. Hence a tubular material specifically developed as a fuse casing material is likely to have the required high dynamic strength, or impact strength, if it is resilient, or ductile, rather than brittle.

Synthetic resin casings of electric fuses required to have a large impact strength must include glass fiber reinforcements. These glass fiber reinforcements may take different forms. Presently synthetic resin casings of fuses generally include convolutely wound woven glass fabric, or filament wound glass fibers.

It is a generally accepted view that the difference between theoretical and observed strength of materials, including glass fibers, is caused by structural irregularities. Extremely fine glass fibers freshly drawn from the melt have optimal strength. If such fibers come into contact with a hard object impairing their surface perfection, their strength is greatly reduced. One may conclude from this established fact that it is desirable to minimize any manipulation of glass fibers intended as reinforcement for synthetic resin fuse tubes which tends to impair their surface perfection. The process of weaving glass fibers involves some fiber manipulation. Yet woven glass fiber fabrics have proven so effective in imparting a high impact strength to fuse casings that it appears sensible not to discard this effective reinforcement material.

It has been found that multiply casings including as reinforcement plies of woven fiber glass cloth and at least one ply of non-woven substantially random oriented glass fibers have a significant dynamic or impact strength.

The behavior of any woven fabric, including glass fiber cloth, in response to external forces depends upon the direction of such forces. A given force acting either in the direction of the warp, or in a direction at 90° to it, i.e. the direction of the weft, tends to have a minimal effect on the integrity of the fabric. Forces acting at about 45° to the warp and the weft of a woven material tend to displace some of the fibers relative to the others. Thus, as far as response to external forces is concerned, woven fabrics are strongly polarized in two principal directions, i.e. that of the warp and that of the weft.

The behavior of mats or webs of glass fibers and of non-woven fabrics of glass fibers in response to external forces is entirely different from that of woven fabrics of glass fibers and can be controlled by the orientation of the constituent fibers thereof. This orientation may vary from substantial unidirectionality to substantial randomness. Therefore, the mechanical behavior of a fuse casing can be controlled within limits by providing the casing with plies of woven glass fiber cloth and one or more plies formed by a mat or mats of glass fibers, or a non-woven glass fiber fabric. For reasons which will become more apparent from what follows below the non-woven ply or plies ought to be sandwiched between two plies of woven glass fiber cloth.

In order to form by pultrusion fuse casings having such multiply reinforcements both plies of woven glass fiber cloth ought to have an extent in excess of 360°, each forming an overlap extending in a direction longitudinally of the casing. Wherever there is an area of such an overlap, the initial thickness of the woven glass cloth reinforcement insert is doubled. In the pultrusion die the overlapping regions of the plies of woven glass fiber fabric are more compressed than the non-overlapping regions of the woven glass fiber fabric and in the pultrusion die the overlapping highly compressed regions of the plies of glass fiber fabric are radially displaced into the ply of glass fiber mat or non-woven glass fiber fabric. This results in a tubing that has for all practical purposes a uniform wall thickness.

For a better appreciation of the invention its genesis may be compared with that of other fuse casing materials, e.g. that of filament wound fuse casings. Filament winding is a process involving the step of wrapping resin-impregnated continuous filaments of glass around a mandrel in successive layers, thus forming a hollow solid of revolution. This process was not invented for the specific purpose of making casings for fuses, but it was found that filament wound tubing lends itself relatively well as a fuse casing material. Since filament wound tubing was not invented for the specific purpose of forming fuse casings, the performance characteristics inherent in filament wound fuse casings do not perfectly match those required for fuse casings. In order to comply with the specific performance characteristic required for electric fuse casings, filament wound fuse casings must be overdesigned in terms of cost and may, in certain aspects, exceed the requirements actually imposed upon casings of electric fuses.

The same as stated above in regard to filament wound casings of electric fuses is also true in regard to other construction methods of casings of electric fuses.

Casings for electric fuses embodying the present invention are an example for the general rule that components specifically evolved to perform specific functions are likely to have better performance characteristics and/or to be more cost-effective, than components which have not been evolved for a specific purpose.

The casings for fuses embodying this invention may be manufactured at cost of the same order as casings of vulcanized fiber. However, the performance characteristics of the former are far superior. One of the many great advantages of fuses embodying the present invention over fuses having casings of vulcanized fiber lies in the far greater dimensional stability of the glass cloth reinforced casings. Such casings greatly facilitate assembly operations on account of their dimensional stability, and the closeness of the tolerances which they keep. The relative resiliency of the casings of fuses embodying this invention is another significant advantage in regard to the assembly of such fuses. Fitting of the ends of a relatively flexible casing into metallic terminal caps or ferrules is analogous to fitting a resilient stopper of rubber into the rigid neck of a glass bottle. The same analogy applies in regard to fitting rigid metallic terminal plugs into the ends of a relatively flexible casing. Here the rigid metallic terminal plugs take the place of the rigid bottle neck, and the resilient casings take the place of the resilient stoppers of rubber.

The above difference in behavior of casings of fuses embodying this invention and of casings of prior art fuses is not readily apparent to the naked eye but can readily be shown by applying appropriate optical magnification.

It can also be shown that under comparable conditions it requires greater pressure inside prior art fuse casings to blast off caps which are simply mounted on them than to blast off caps from casings of fuses embodying the present invention.

SUMMARY OF THE INVENTION

Fuses embodying this invention include a fusible element and arc-quenching means surrounding said fusible element. Said fusible element and said arc-quenching means are housed in a casing of synthetic-resin-glass-cloth laminate. A pair of terminal elements is mounted on the ends of, and supported by, said casing. The terminal elements are conductively interconnected by said fusible element. The casing includes a first ply formed of glass fiber mat material having non-uniformly oriented fibers, and a second ply and a third ply arranged on opposite sides of said first ply and sandwiching said first ply. Said second ply and said third ply are of woven glass fiber fabric each forming an overlap extending in a direction longitudinally of said casing. The overlap of said second ply and the overlap of said third ply are angularly displaced relative to each other. Said casing further includes a thermosetting resin integrating said first ply, said second ply and third ply into a laminate. The glass fiber density of said laminate is locally increased at the region of said overlap of said second ply and at the region of said overlap of said third ply to such an extent that the wall thickness of said casing is virtually uniform along the entire periphery or perimeter thereof.

DESCRIPTION OF PREFERRED EMBODIMENTS

Figure 1:
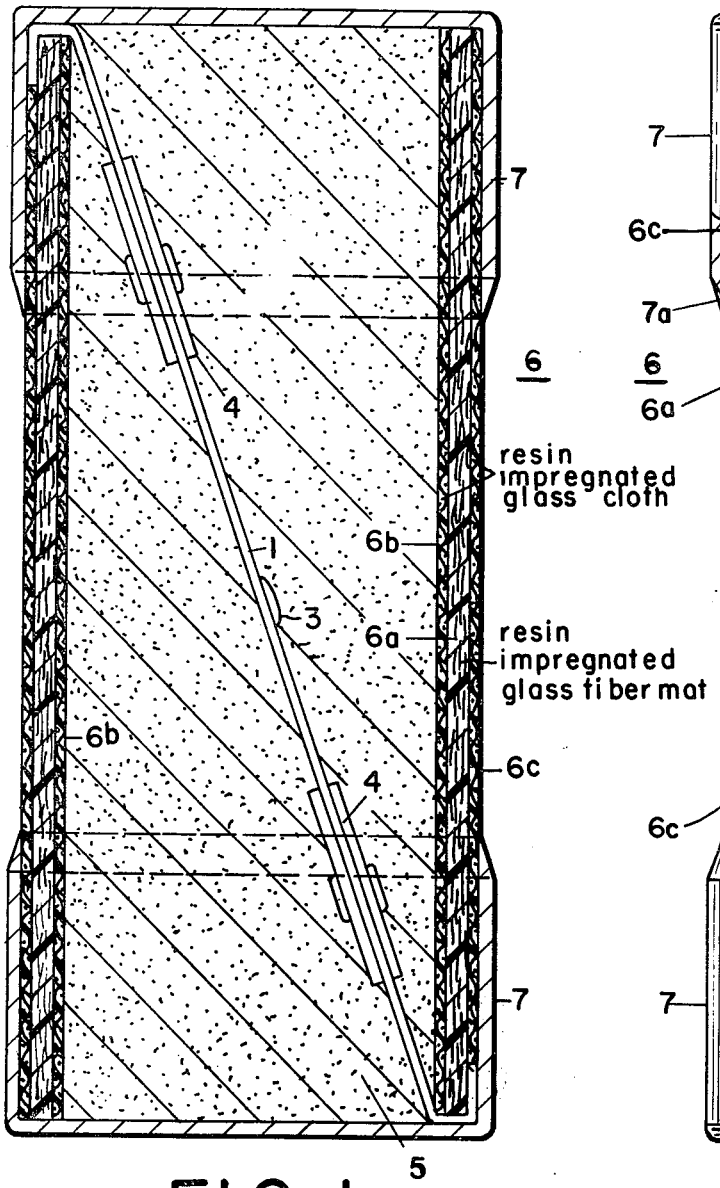
FIG. 1 is substantially a longitudinal section of a low-voltage fuse embodying this invention, some parts thereof being shown in elevation rather than in section.
Figure 2:
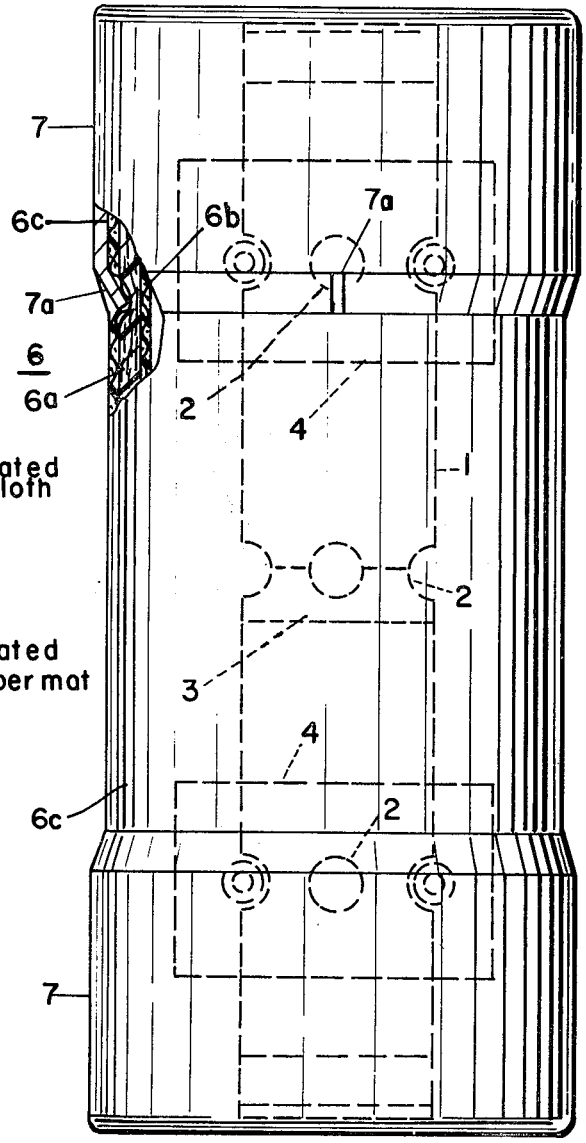
FIG. 2 is substantially a side elevation of the fuse structure of FIG. 1 showing a small portion thereof in section.
Figure 13:
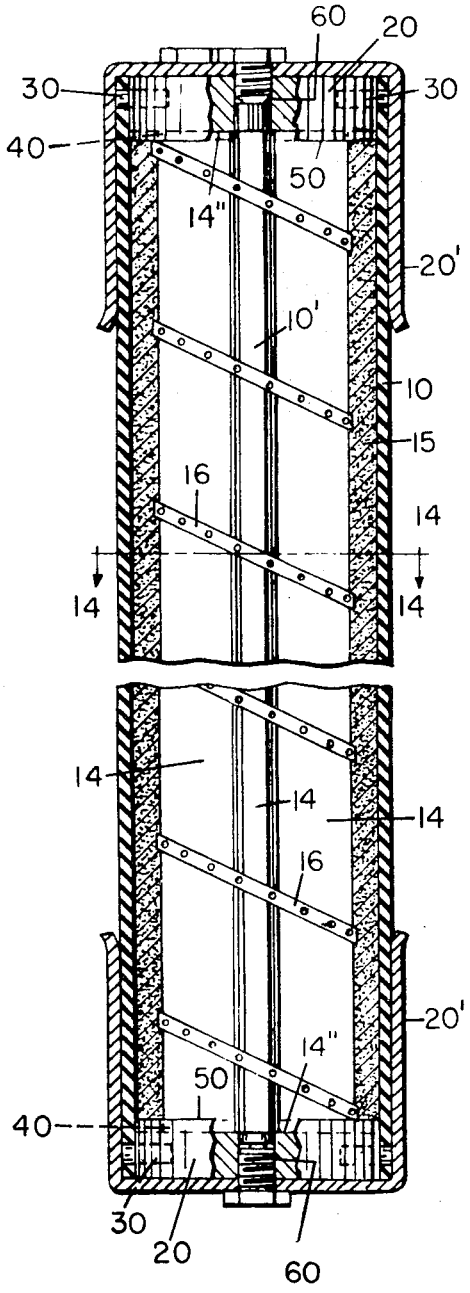
FIG. 13 is partly a longitudinal section and partly an elevation of a high-voltage fuse embodying this invention.
Figure 14:
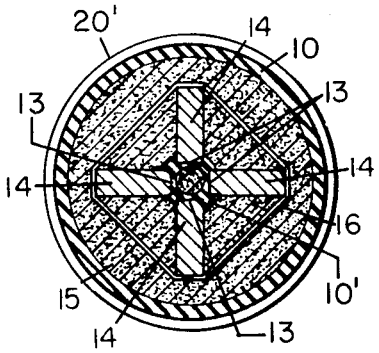
FIG. 14 is a section along 14—14 of FIG. 13.

Referring to FIGS. 1 and 2, numeral 1 has been applied to indicate a fusible element in ribbon-form provided with perforations 2 forming three serially related areas of reduced cross-section. The central of these areas is provided with a low fusing point overlay 3, e.g. of tin, for severing fusible element 1 on occurrence of small overlaps of excessive duration. The axially outer areas of reduced cross-section are sandwiched between arc-voltage control plates 4 described in detail in U.S. Pat. No. 2,964,604 to P. C. Jacobs et al. Dec. 13, 1960 for CURRENT-LIMITING FUSES HAVING COMPOUND ARC-VOLTAGE GENERATING MEANS. In FIG. 1 fusible element 1 and plates 4 are shown in elevation rather than in section. Fusible element 1 is surrounded by arc-quenching means, preferably a body 5 of pulverulent or grandular filler, e.g. a body of quartz sand. Fusible element 1 and the body 5 of arc-quenching filler are enclosed in a tubular casing of a novel synthetic-resin-glass-cloth laminate generally designated by numeral 6. Casing 6 supports on the ends thereof a pair of terminal elements 7, e.g. in form of caps, or ferrules. Instead of being formed by caps or ferrules, the fuse might be provided with terminal elements in form of plugs inserted into the ends of casing 6 and pinned to the latter by steel pins, as shown in FIGS. 13 and 14. The fusible element 1 is bent over the rims of casing 6 to the outer surface thereof, and caps 7 are mounted on the portions of fusible element 1 situated on the outside of casing 6. Thus caps or ferrules 7 are conductively interconnected by fusible element 1. To minimize the resistance of the current path from one cap 7 to the other, the ends of fusible element 1 are preferably soldered to caps 7 in a fashion and by means well known in the fuse art.

The specific fuse structure shown in FIGS. 1 and 2 is intended for a current rating of 60 A at 600 V and to comply with Nema Class J requirements.

Figure 2A:
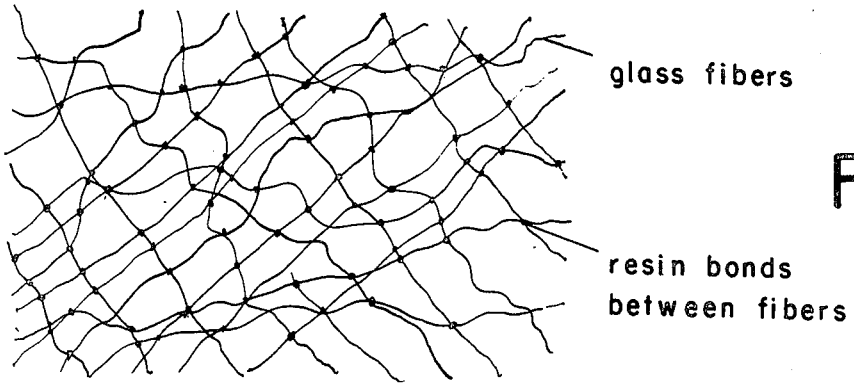
FIG. 2*a* is a view of a non-woven glass fiber mat forming part of the structure of FIGS. 1 and 2.

Casing 6 includes a first or intermediate ply 6*a* formed of a non-woven glass fiber mat material as shown in FIG. 2*a*, a second radially inner ply 6*b* of woven glass fiber fabric and a third radially outer ply 6*c* likewise of woven glass fiber fabric. The intermediate ply 6*a* is sandwiched between plies 6*b*, 6*c*. Casing 6 further includes a thermosetting resin integrating plies 6*a*, 6*b*, 6*c* into a tubular laminate.

Figure 3:
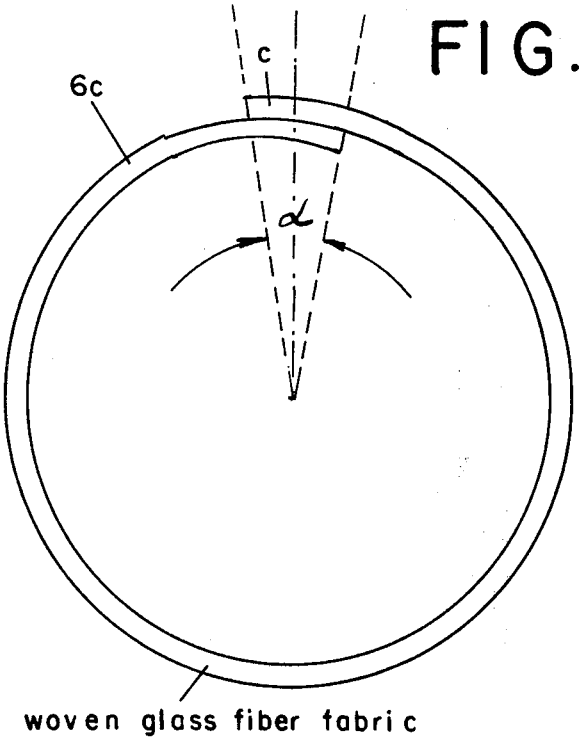
FIGS. 3–5, inclusive, are diagrammatic end views of the three constituent plies of the casing structure of FIGS. 1 and 2.
Figure 4:
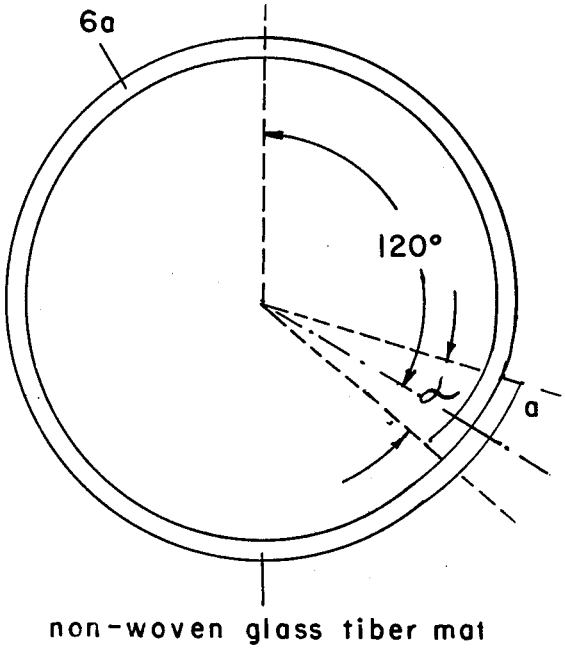
Figure 5:
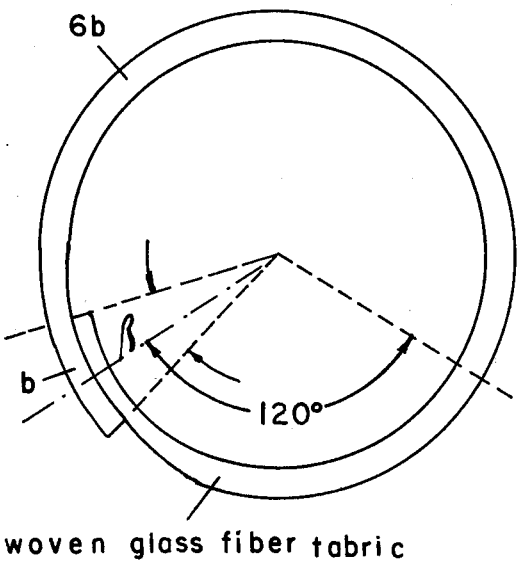
Figure 6:
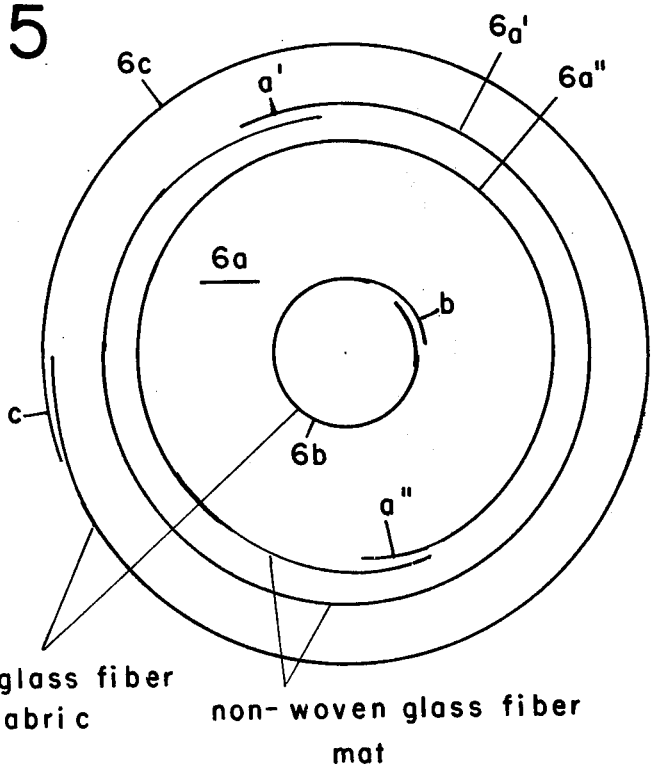
FIG. 6 is a diagrammatic representation of a modified multiply casing structure for an electric fuse.
Figure 7:
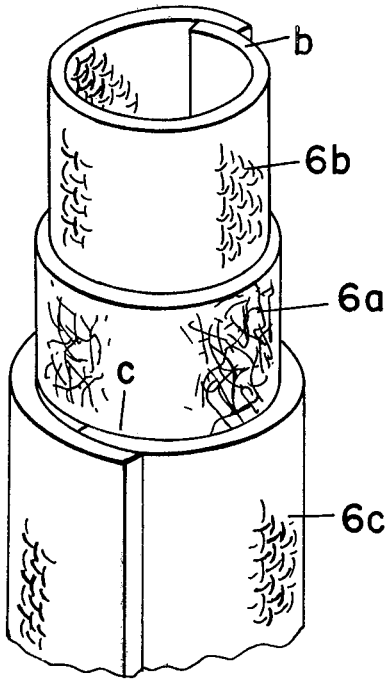
FIG. 7 is a diagrammatic isometric view of three different levels of three plies intended to reinforce a fuse casing structure.

The configuration of the glass fiber reinforcement inserts forming plies 6*a*, 6*b* and 6*c* are shown diagrammatically in FIGS. 3, 4 and 5, and modifications of what is shown in these figures are shown in FIGS. 6 and 7.

FIG. 3 shows diagrammatically an end view of the insert forming outer ply 6*c* of woven fiber glass fabric. The insert or ply 6*c* has a circumferential extent in excess of 360° or, to be more specific, 360° plus $\alpha$°. Ply 6*c* forms an overlapping area *c* where two layers of the insert or ply 6*c* are superimposed.

As diagrammatically shown in FIG. 4 the ply 6*a* of a non-woven glass fiber fabric or a glass fiber mat made up of non-uniformly oriented fibers has a circumferential extent of 360° plus $\alpha$. Ply 6*a* forms an overlapping area a where two layers of ply 6*a* are superimposed. The area a is angularly displaced 120° relative to the area *c* shown in FIG. 3.

As diagrammatically shown in FIG. 5, the radially inner ply 6*b* of woven glass fiber fabric has a circumferential extent of 360° plus $\beta$°. Ply 6*b* forms an overlapping area *b* where two layers of ply 6*b* are superimposed. The area *b* is angularly displaced about 120° relative to areas *c* and *a*.

The overlaps or overlapping areas *c*, *a*, *b* extend in a direction longitudinally of casing 6 shown in FIGS. 1 and 2.

The intermediate ply 6*a* is preferably made up of several superposed layers of non-woven fiber mat material consisting of randomly oriented glass fibers which are resin bonded to each other at points of their intersection as shown in FIG. 2*a*.

FIG. 6 shows diagrammatically the joint arrangement of reinforcing layers. Since FIG. 6 is merely intended to show the relative orientation of the constituent plies 6*a*, 6*b*, 6*c* of casing 6, and of the constituent layers of ply 6*a*, ply thickness and layer thickness have not been indicated in FIG. 6.

As shown in FIG. 6 the outer ply 6*c* forms an overlap *c* and the inner ply 6*b* forms an overlap *b*. Overlaps *c* and *b* are angularly displaced 180°, and this is the preferred angular relationship of the overlapping areas *c* and *b* of outer ply 6c and inner ply 6b. As further shown in FIG. 6, the intermediate ply 6a, i.e. that sandwiched between plies 6c and 6b, is formed by two superimposed layers 6a' and 6a''. Each of layers 6a', 6a'' has an angular extent in excess of 360°. Layer 6a' forms an overlapping area *a'* and layer 6a'' forms an overlapping area *a''*. Overlapping areas or overlaps *a'* and *a''* are angularly displaced relative to each other 180°, and are angularly displaced 90° relative to overlaps *c* and *b*.

The presence of overlaps *c* and *b* formed by the radially outer ply 6c and in the radially inner ply 6b is mandatory. The intermediate ply 6a does not necessarily form an overlap, or have an area of overlap. This has been illustrated in FIG. 7. This figure shows a portion of each of the three inserts 6a, 6b, 6c of casing 6. As shown in FIG. 7 the intermediate ply 6a has no overlap. The outer ply 6c and the inner ply 6b each form an overlap *c* and *b*, respectively. Overlaps *c* and *b* are angularly displaced 180°, and in this respect the structures of FIGS. 6 and 7 conform. When an insert having points of different thickness is resin impregnated and drawn through a pultrusion die a tube of uniform wall thickness results.

Figure 8A:
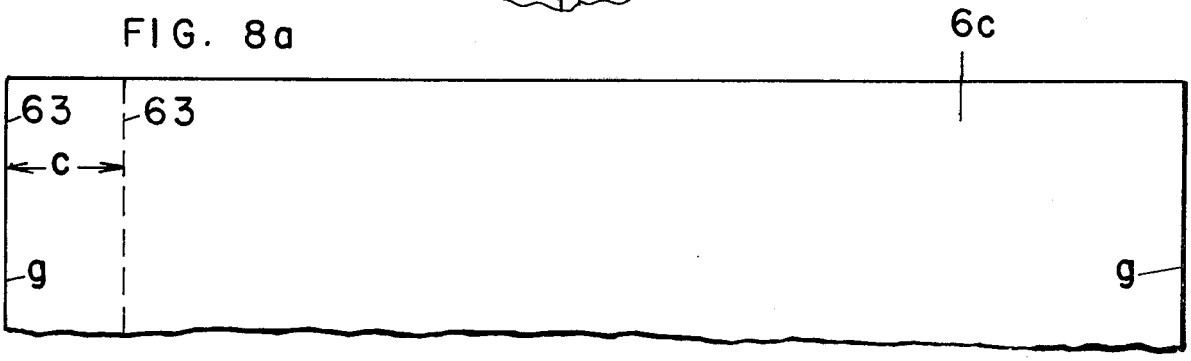
FIGS. 8*a*, 8*b* and 8*c* show the three plies of FIGS. 3–5 upon being cut open along a generatrix thereof, and unfolded into the plane of the drawing paper.
Figure 8B:
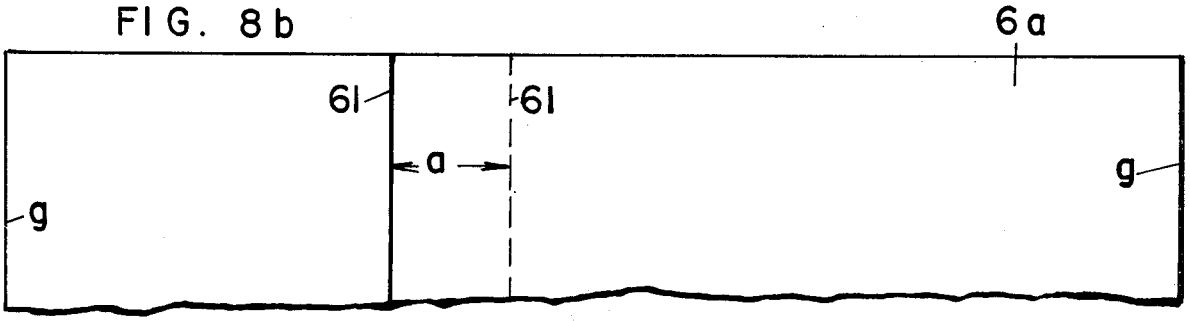
Figure 8C:
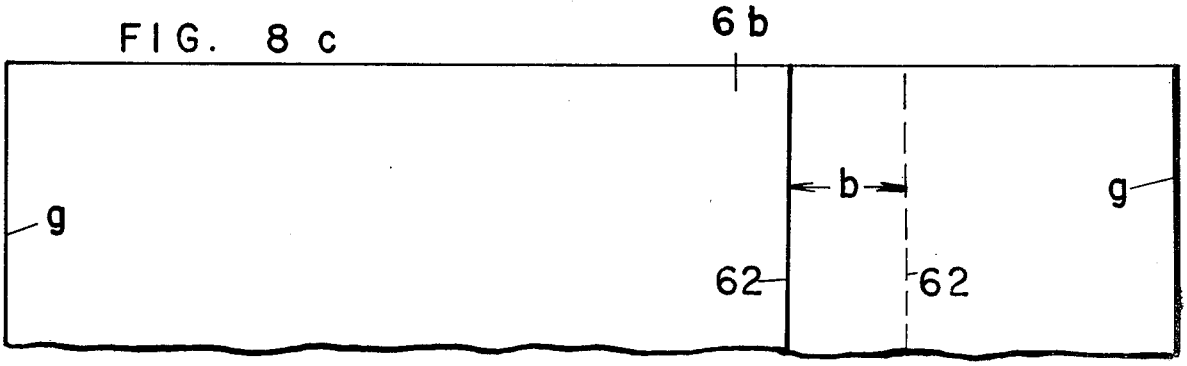

FIGS. 8a–8c show the three plies 6c, 6a, 6b of FIGS. 3, 4 and 5 cut open along a generatrix *g* of casing 6 and unfolded into the plane defined by the surface of the drawing. Since the three inserts 6c, 6a, 6b have progressively decreasing radii, the width of the three strips 6c, 6a, 6b may decrease progressively. This feature has not been shown in FIGS. 8a–8c. Reference character 61 indicates the edges of ply 6a limiting overlapping region *a*, reference character 62 has been applied to indicate the edges of ply 6b limiting overlapping region *b*, and reference character 63 has been applied to indicate the edges of ply 6c limiting overlapping *c*.

At the point, or area, where an overlap occurs, the thickness of the reinforcement structure 6a, 6b, 6c undergoes a local increase. At these particular points *a*, *b*, *c* the reinforcement inserts 6a, 6b, 6c are compressed to a larger extent than at other points and the ratio of glass fibers to synthetic resin is increased. This does not affect the uniformity of the wall thickness, or that of the outer diameter and inner diameter of the casing because of nesting of plies 6b, 6c and because of the resiliency and relatively small initial glass fiber density of the intermediate ply 6a at the overlapping areas *c* and *b* of plies 6c, 6b. The overlapping area *c*, *b* of plies 6c, 6b are pushed into the ply 6a when the three plies 6c, 6a, 6b are pulled through the fuse-case-forming pultrusion die. This has been illustrated in FIG. 9, and also in FIG. 15.

Figure 9:
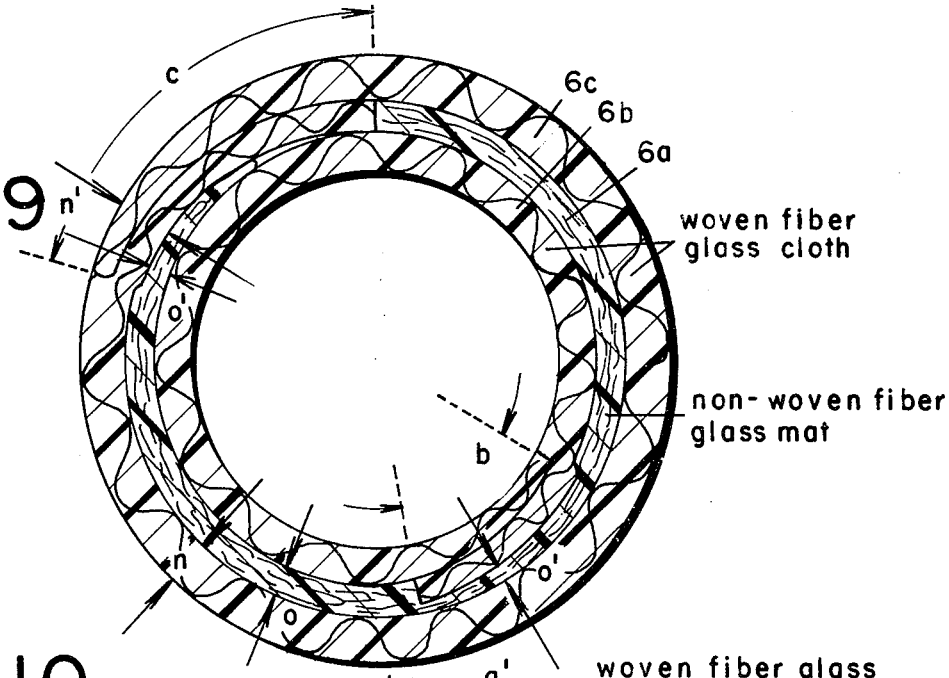
FIG. 9 is a diagrammatic cross-section of a fuse tube embodying this invention.

The structure of FIG. 9 is made up of three plies 6a, 6b, 6c. Ply 6a is formed of a non-woven glass fiber fabric having non-uniformly oriented or randomly oriented fibers. Ply 6a is sandwiched between plies 6b, 6c of woven glass cloth or fabric. Ply 6c overlaps at *c*, and ply 6b overlaps at *b*. Ply 6c has a thickness *n* at all points along the perimeter of the tubular structure except in the region of overlap *c*. In the region of overlap *c* the thickness *n'* of ply 6c is less than $2n$, but larger than $n(n < n' < 2n)$. *n'* is not a constant but increases in clockwise direction and is almost $2n$ where the overlapping region of ply 6c ends. In the region of overlap *c* the compression of ply 6c is larger than outside of that region and wherever $n' < n$, the ply 6c is displaced radially inwardly into the intermediate ply 6a. This is readily possible on account of the high compressibility of the glass fiber mat material of which ply 6a consists. Ply 6a has a thickness *o* at all points thereof along the perimeter of the tubing structure, except at the regions juxtaposed to overlaps *c* and *b*. At the regions of overlaps *c* and *b* the thickness *o'* of the intermediate ply 6a is reduced. The radial compression of ply 6b is largest in the region of overlap *b* and in that region ply 6b is displaced radially outwardly into ply 6a. The latter yields readily to pressure exerted by the pultrusion die on account of its initial small glass fiber density. The relatively small initial glass fiber density in the intermediate ply 6a is also a factor determining the relatively large elasticity of the structure of FIG. 9. It will be noted that the intermediate ply 6a of FIG. 9 has an extent of 360° and does not overlap at any point along the perimeter thereof. Thus the structure of FIG. 9 results from processing a multiply reinforcement insert as shown in FIG. 7.

The relatively high resiliency of the three ply casing 6 described above tends not only to increase its impact strength but has additional advantages. As mentioned before, when terminal caps are mounted on such a three ply casing, the casing and the terminal caps coact somewhat like a bottle rubber stopper and the neck of a glass bottle. This makes it possible to mount the terminal caps in a novel way illustrated in FIGS. 1 and 2, but not claimed as my invention.

As shown in FIGS. 1 and 2 caps 7 made of a relatively ductile metal are press-fitted upon the ends of casing 6 in such a way as to cause a slight elastic deformation of the latter. The axially inner ends of caps 7 are deformed by rollers (not shown) to assume the shapes of frustums of cones, also shown in FIGS. 1 and 2. The axially inner ends of caps 7 are staked as indicated at 7a in FIG. 2 (but not shown in FIG. 1), so that a small portion of caps 7 is driven into the radially outer ply 6c of casing 6. It has been found that if a three ply casing as described above is provided with caps in the above described manner, the latter are capable of withstanding higher internal explosive pressures than if the caps are mounted in exactly the same fashion on another less resilient or more brittle casing, e.g. a comparable casing of convolutely wound synthetic-resin-impregnated woven glass fiber fabric.

Figure 10:
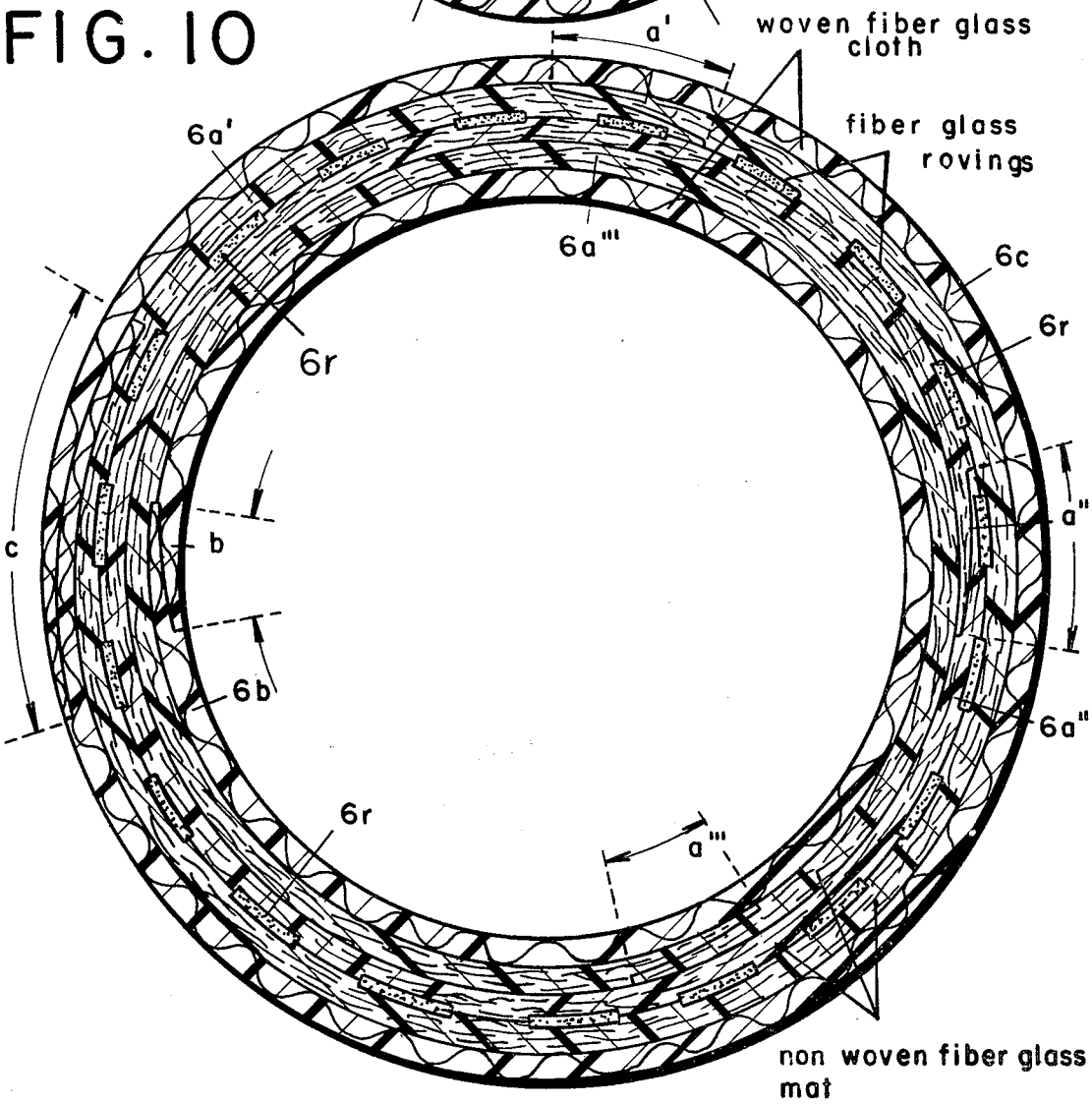
FIG. 10 is a diagrammatic cross-section of a fuse casing embodying this invention having a relatively large diameter such as used in fuses having a relatively high current rating.

FIG. 10 illustrates a tubing of relatively larger diameter than that shown in FIG. 9 comprising a larger number of plies. The tubing of FIG. 10 includes an outermost ply 6c of glass fiber cloth overlapping at *c*, a first intermediate ply 6a' of a non-woven mat of substantially randomly oriented fibers overlapping at *a'*, an intermediate ply 6r formed by spaced glass fiber rovings arranged in a squirrel-cage-like fashion and extending in a direction longitudinally of the tubular casing structure, an intermediate ply 6a'' of a non-woven mat of randomly oriented fibers overlapping at *a''*, an intermediate ply 6a''' of a non-woven mat of substantially randomly oriented fibers overlapping at *a'''* and an innermost ply 6b of woven glass fiber cloth overlapping at *b*.

It will be noted that the overlapping regions *a'*, *a''* and *a'''* of the intermediate plies 6a', 6a'', 6a''' are angularly displaced relative to the overlapping region *c* of the outermost ply 6c, but that the overlapping region *b* of the innermost ply 6b is not angularly displaced relative to the overlapping region *c* of the outermost ply 6c.

As a general rule it is of great importance that the overlaps *b*, *c* of the innermost and the outermost plies of woven glass fiber fabric be angularly displaced. FIG. 10 shows an exception to that general rule. The exception obtains in cases where a relatively large number of intermediate plies of non-woven glass fiber mat is arranged between the innermost and outermost plies of woven glass fiber cloth, each of the intermediate plies forming an overlap such as overlaps *a'*, *a''*, *a'''* which are angularly displaced. FIG. 10 has been drawn to show a structure which is satisfactory in the absence of an angular displacement between the overlapping areas or regions *b*, *c* of the innermost ply 6*b* and the outermost ply 6*c* of woven glass cloth.

The arrangement of plies of the structure of FIG. 10 may be changed as follows, beginning with the radially inner ply 6*b* of glass cloth:

6*b* glass cloth overlapping
6*a'''* non-woven mat overlapping
6*r* rovings
6*a''* non-woven mat overlapping
6*a'* non-woven mat overlapping
6*c* glass cloth overlapping. In such a structure all the overlaps *b*, *a'''*, *a'* and *c* of the constituent plies of the tubing or casing should preferably be angularly displaced relative to each other as shown in FIG. 12.

Figure 11:
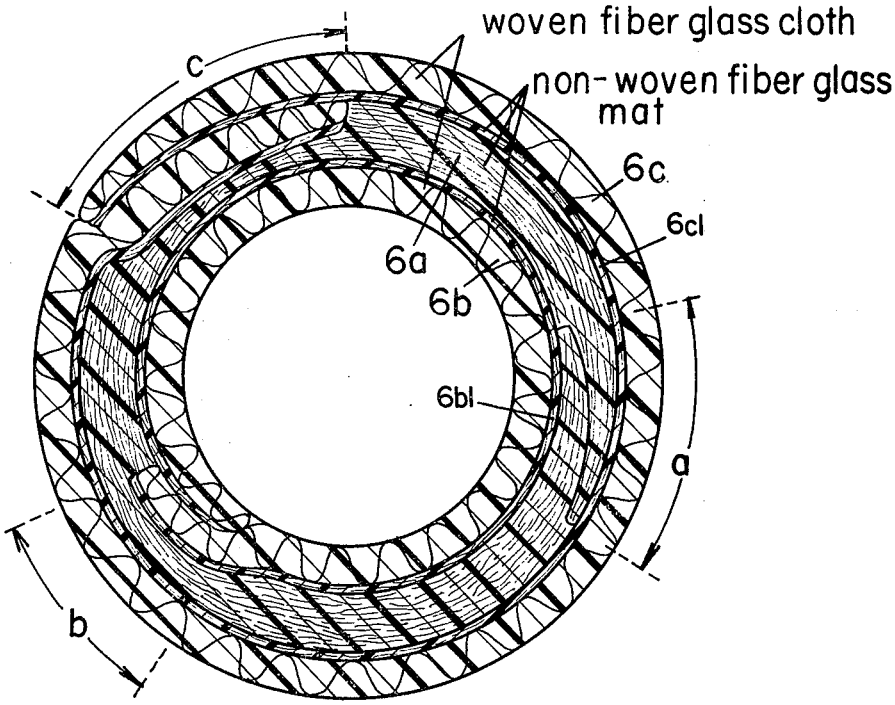
FIG. 11 is a diagrammatic cross-section of another fuse casing structure embodying this invention.
Figure 12:
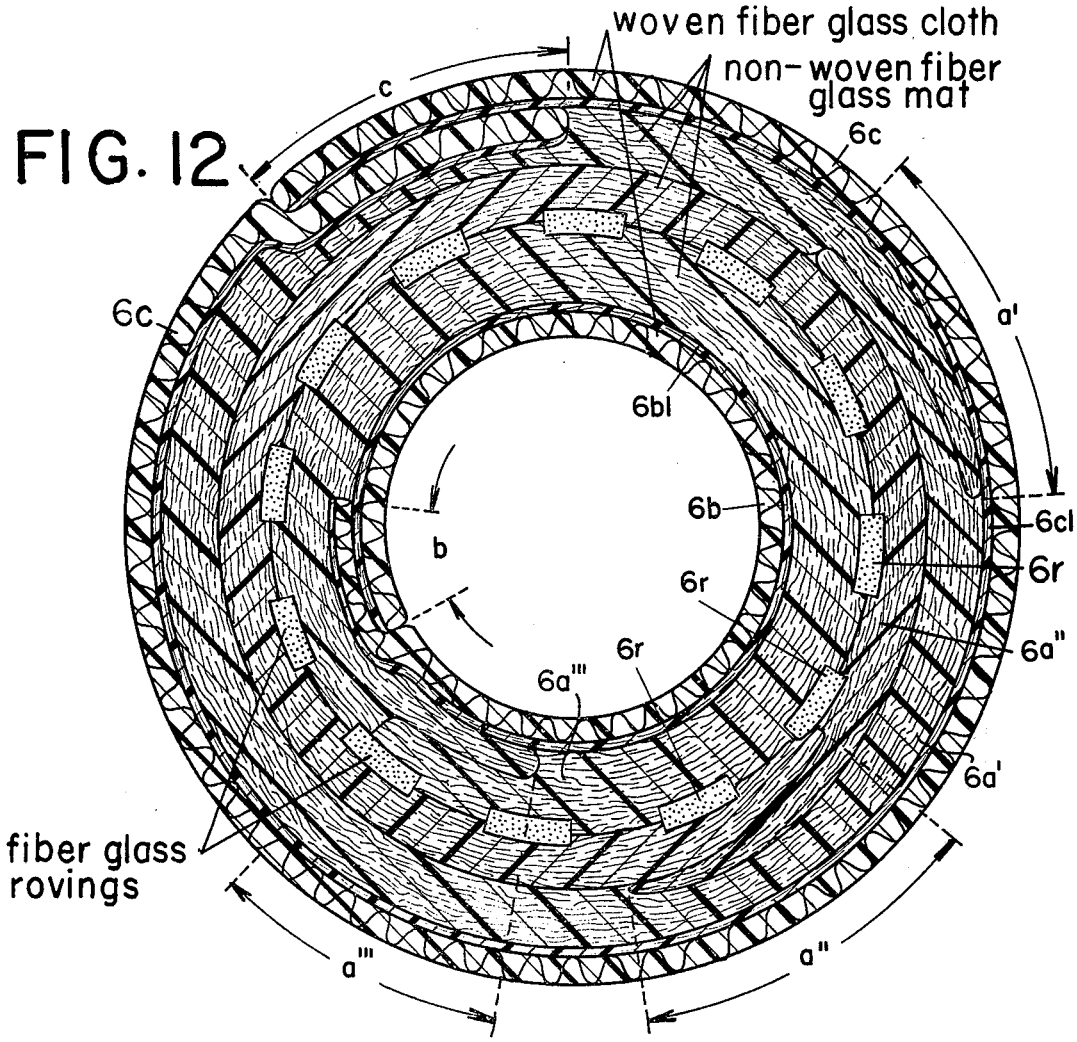
FIG. 12 is a diagrammatic cross-section of still another fuse casing structure embodying this invention.

FIGS. 11 and 12 relate to fuse casing materials designed to meet the most stringent requirements that have been encountered to-date.

In the structure of FIGS. 11 and 12 reference characters 6*c* and 6*b* have been applied to indicate the outermost ply and the innermost ply, respectively of a fuse casing. Plies 6*c* and 6*b* overlap at *c* and *b*, respectively. Ply 6*c* as well as ply 6*b* are of woven glass fiber cloth. The innermost ply 6*b* of the casings shown in FIGS. 11 and 12 has a liner layer 6*b*1 on the inside thereof and the outermost ply 6*c* of that casing has also a liner layer 6*c*1 on the inside thereof. Liner layers 6*b*1 and 6*c*1 are of a non-woven fiber mat of the kind shown in FIG. 2*a*. Liner layer 6*b*1 is substantially coextensive with the ply 6*b* of woven glass fiber cloth and liner layer 6*c*1 is substantially coextensive with ply 6*c* of woven glass fiber cloth. Liner layer 6*b*1 overlaps at an area which is substantially coextensive with the area of overlap *b* of ply 6*b* of woven glass fiber cloth and liner layer 6*c*1 overlaps at an area which is substantially coextensive with the area of overlap *c* of ply 6*c* of woven glass fiber cloth. It is desirable to provide plies 6*b* and 6*c* with coextensive non-woven liners or linings 6*b*1 and 6*c*1. As an alternative, but one of the two plies 6*b*, 6*c*, preferably the ply 6*b*, may be provided with a coextensive non-woven glass fiber lining.

As shown in FIG. 11, the tube includes one or more plies 6*a* of non-woven fiber glass mat arranged between plies 6*c*, 6*c*1, 6*b*, 6*b*1.

Referring now to FIG. 12, the tube shown therein includes in addition to the plies 6*c*, 6*c*1 and 6*b*, 6*b*1 a ply 6*a'''* having an overlap at *a'''*, a ply formed by spaced rovings 6*r* forming a squirrel-cage-like structure extending in a direction longitudinally of the tubing, a ply of non-woven fiber glass mat 6*a''* overlapping at *a''* and another ply of glass fiber mat 6*a'* overlapping at *a'*. The overlapping areas *b*, *a'''*, *a''*, *a'* and *c* formed by the aforementioned plies are angularly displaced. Ply 6*a'* is particularly dense where the overlap *c* of ply 6*c*, 6*c*1 is pushed into the former and ply 6*a'''* is particularly dense where the overlap *b* of ply 6*b*, 6*b*1 is pushed into the former.

Referring now to FIGS. 13 and 14, the fuse shown therein is a high-voltage fuse described in detail in U.S. Pat. No. 3,846,728 to Erwin Salzer; Nov. 5, 1974; for HIGH-VOLTAGE FUSE INCLUDING INSULATING MANDREL FOR SUPPORTING FUSIBLE ELEMENTS. Tubing as shown in FIGS. 11 and 12 is particularly suited for such a fuse structure.

In FIGS. 13 and 14 numeral 10 has been applied to indicate a tubular casing. Casing 10 is closed on the ends thereof by a pair of terminal plugs 20 of copper or brass. Steel pins 30 project transversely through casing 10 and into plugs 20, firmly securing the latter to the former. Each of the pair of plugs 20 has a pair of narrow grooves 40 in the axially inner end surface 50 thereof. Grooves 40 are arranged at right angles. Each plug 20 has a circular center recess 60 in the axially inner end surface 50 thereof. The depth of recess 60 exceeds that of grooves 40. Post 10' is arranged in the center of casing 10 in coaxial relation thereto. The ends of post 10' are reduced in diameter and their diameter is equal to the diameter of recesses 60 and project into recesses 60. Each recess 60 in end surfaces 50 includes an axially inner portion of relatively large diameter and an axially outer portion of relatively small diameter forming a shoulder between said axially inner portion and said axially outer portion. Each reduced diameter end of post 10' forms a shoulder between it and the large diameter portion of the post 10'. The shoulders on each end of post 10' abut against a shoulder formed in terminal plugs 20. Post 10' has grooves 13 in the lateral surfaces thereof extending in a direction longitudinally of post 10'. There are four such grooves 13 in post 10' and these grooves are angularly displaced 90°. Reference character 14 has been applied to indicate four substantially rectangular plates of heat-resistant electric insulating material arranged inside of casing 10, each having relatively long edges and relatively short edges. The radially inner relatively long edges of plates 14 engage grooves 13 in post 10' and the axially outer relatively short edges 14'' of plates 14 engage the grooves 40 in the axially inner end surfaces 50 of terminal plugs 20. Thus three edges including a long edge of each of plates 14 have a firm support virtually eliminating the danger of breading of plates 14. A fuse link 16 of silver is wound helically around the radially outer edges of the four plates 14 and conductively interconnects terminal plugs 20. The pulverulent arc-quenching filler 15 — preferably quartz sand — fills the space inside of casing 10 unoccupied by post 10', plates 14 and fuse link 16. Fuse link 16 is preferably formed by a silver ribbon having a plurality of serially related points of reduced cross-sectional area. The relatively long radially inner edges of plates 14 are connected into grooves 13 of post 10'. In similar fashion, transverse or radial edges 14'' projecting into grooves 40 are bonded to plugs 20 by means of cement. If post 10' is tubular, the inside thereof should be filled with the pulverulent arc-quenching filler 15. Ferrules 20' are mounted on the ends of casing 10 and may be screwed against plugs 20.

If post 10' is tubular and filled with a pulverulent arc-quenching filler, post 10' may be used to house a restraining wire for a spring-biased blown fuse indicator.

Any synthetic thermosetting resin that lends itself to processing in a pultrusion machine lends itself to manufacturing multiply tubing and fuse casings of the above description. If it is intended to cure the tubing by high frequency electrical oscillations the resin must include polar molecules caused under the action of an electric field to move at high velocities. These molecules collide with adjacent molecules — whether polar or not polar — and impart some of their kinetic energy to the latter. The process of high frequency curing of pultruded parts is well known in the art, and does not call for specific description in this context.

A harder and other ingredients must be admixed to the thermosetting resin. The formulation of the mixture depends upon the application of the tubing. Tubing intended to be used as casing material for electric fuses calls for thermosetting resins which include inorganic fillers, anti-tracking fillers and flame-retardent or resistant media. Such substances are well known in the art and reference may be had, in this connection, for instance to U.S. Pat. No. 3,287,525 to H. W. Mikulecki; Nov. 22, 1966 describing such substances. Thermosetting resins which are particularly flame-resistant are also often referred-to as self-extinguishing resins and are well known in the art.

Pultrusion machinery is also well known in the art and reference may be had to the following patents in regard to a detailed disclosure of pultrusion machinery. U.S. Pat. No. 2,871,911 to W. B. Goldworthy et al., Feb. 2, 1959 for APPARATUS FOR PRODUCING ELONGATED ARTICLES FROM FIBER-REINFORCED PLASTIC MATERIAL and U.S Pat. No. 3,556,888 to W. B. Goldworthy, Jan. 19, 1976 for PULTRUSION MACHINE AND METHOD.

Figure 15:
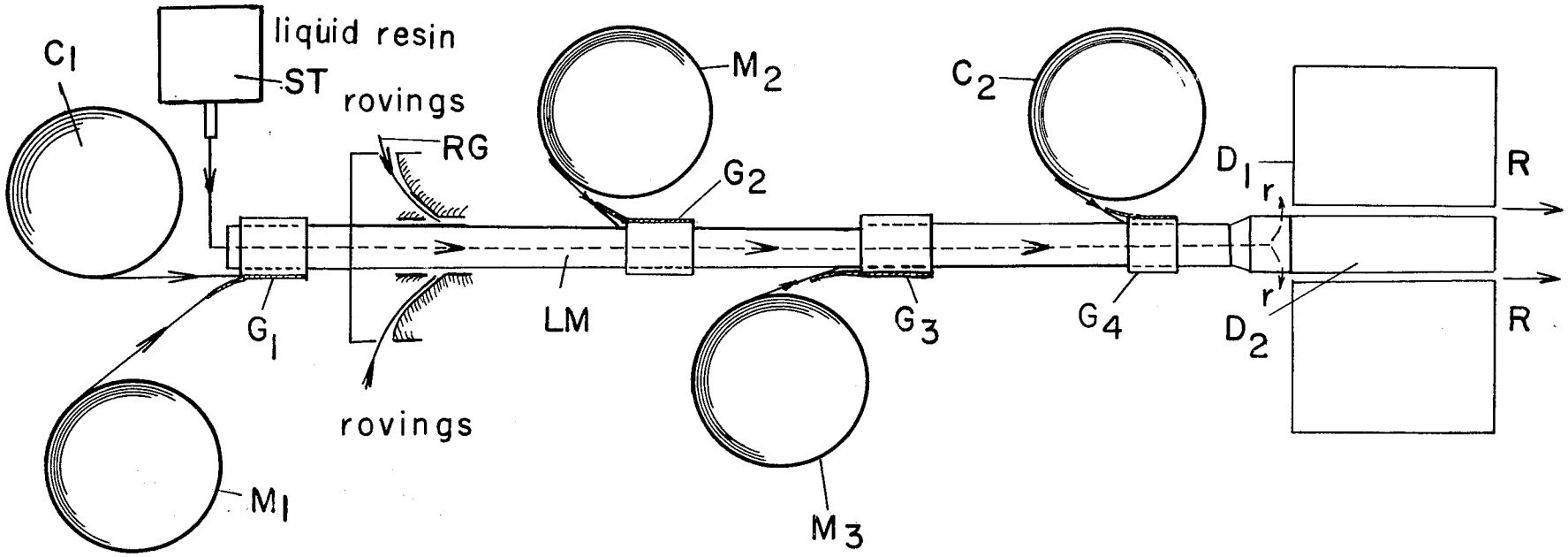
FIG. 15 is a diagrammatic representation of a pultrusion machine for making tubular structures embodying this invention.

FIG. 15 shows diagrammatically a pultrusion machine as disclosed in the above referred-to U.S. Pat. No. 3,556,888 adapted to produce fuse casings, or other high-strength tubing material.

Reference character $C_1$ has been applied to indicate a supply roll of woven fiber glass cloth and reference character $M_1$ has been applied to indicate a supply roll of glass fiber mat having substantially random oriented fibers as shown in FIG. 2*a*. The strips of woven fiber glass cloth derived from roll $C_1$ is directly folded upon a long mandrel LM and the strip of non-woven mat derived from roll $M_1$ is folded on mandrel LM above the innermost layer derived from roll $C_1$. The guiding and folding of the materials derived from rolls $C_1$ and $M_1$ is effected by means of the guiding and folding device $G_1$. Glass fiber rovings derived from a source of such material (not shown) are deposited on mandrel LM over the layers derived from rolls $C_1$ and $M_1$ in such a way as to form a squirrel-cage-like structure of peripherally spaced rovings surrounding mandrel LM and engaging the strip of non-woven glass mate derived from drum $M_1$. This deposition of rovings is effected by means of a roving guide structure RG having an axially inner surface substantially in the shape of a truncated cone. Reference characters $M_2$ and $M_3$ have been applied to indicate a pair of supply rolls of glass fiber mat having substantially random oriented fibers. A strip of such material derived from roll $M_2$ is supplied to guiding and folding device $G_2$ and folded around the layer of rovings on mandrel LM. Another strip of glass fiber mat material derived from roll $M_3$ is supplied to guiding and folding device $G_3$ and folded over the layer derived from roll $M_2$. Reference character $C_2$ has been applied to indicate a supply roll of woven fiber glass cloth for forming the outermost ply of the multiply tubing material. The strip of woven fiber glass cloth derived from supply roll $C_2$ enters a guiding and folding device $G_4$ and is folded around the radially inner layers of fiber glass material supported by mandrel LM. The mandrel LM has a predetermined diameter which is relatively small, except on its right end where the diameter of mandrel LM is increased. As a result, the several layers of woven glass cloth and non-woven glass fiber mat rest relatively loosely on mandrel LM except on the right enlarged end of the latter, where the constituent reinforcement plies of the tubing are expanded radially outwardly. The mandrel LM is hollow, or has a central bore. Synthetic resin under pressure is admitted from supply tank ST to the left end of mandrel LM and flows through the latter to the right end thereof. The several plies of fiber glass material on mandrel LM are not wetted by the synthetic resin before these plies have been radially expanded by the right end of mandrel LM of increased diameter. Curing of the impregnating resin is effected in a heated die including the outer tunnel forming portion $D_1$ and the inner mandrel shaped portion $D_2$ defining a toroidal annular gap therebetween. The finished product is pulled through that gap in the direction of the arrows R by conventional pulling machinery as used in pultrusion machines.

The impregnation with resin of the multiply fibrous reinforcement insert formed on mandrel LM occurs at a point situated at the right end of mandrel LM indicated by arrows *r*. At this point the synthetic resin is allowed to flow radially outwardly from the inside of mandrel LM transversely through the multiple plies on mandrel LM. The excess of synthetic resin not used for impregnating the constituent reinforcement plies of the casing is drained off by appropriate draining means not shown in FIG. 15. Impregnation of the reinforcement plies of the tubing is effected at a point following radial expansion of these plies and before the latter are allowed to enter into the toroidal gap formed between parts $D_1$ and $D_2$.

As stated above, the term impact strength, or dynamic strength, as used in this context, refers to the ability of casings of fuses to withstand stresses resulting from explosive pressures in the inside thereof. The magnitude of such pressures varies within wide limits as will be apparent from the following considerations. Assuming that under short-circuit conditions a fusible element initially forms but a single break close to the center thereof, and that the diameter of the casing is relatively small in comparison to its length. In such a situation the median region of the fuse casing is likely to be exposed to maximal pressure and there will be a steep pressure gradient in axially outward direction. The situation will be entirely different in instances where the fusible element has a more or less uniform cross-section and fuses under short-circuit conditions substantially simultaneously at all points along its entire length. In such an instance the dynamic load imposed upon the wall of the casing is substantially uniform along its entire length. Experiments have shown that multiply fuse casings, as described above, are capable of coping with each particular shock pressure that may occur in electric fuses though the casing may require within the basic concepts underlying this invention modifications to suit any particular situation.

The term impact strength is often applied as an indication of the energy necessary to fracture a standard notched bar by the swing of a heavy pendulum. It is apparent from the above that the term impact strength is not being used in this context in this specific sense which is often attributed to it.

The present tubular structure has been developed to meet the specific requirements of fuse casings and to coact with other parts of fuses incident to interruption of short-circuit currents so as to withstand high shock loading with maximal cost-effectiveness. The resulting tubular structure has not only a high dynamic strength in regard to pressures generated by exploding fusible elements, but has also a considerable hoop strength, or bursting strength, within the meaning of ASTM Standard D 1180-57 (1961) "Bursting Strength of Round Rigid Plastic Tubing". Hence the use of the tubular structures which have been outlined above is not limited to casings of fuses. These structures are applicable wherever plastic tubing is needed whose strength to withstand almost instantaneous loading by internal pressures is high, and wherever plastic tubing is needed whose bursting strength within the meaning of the above ASTM Standard is high.

While my invention is primarily concerned with cylindrical fuse casings and cylindrical tubing, it will be apparent that it is also applicable to fuse casings and tubing that are rectangular or square in cross-section.

I claim as my invention:

1. An electric fuse comprising:

a. a fusible element;

b. an arc-quenching means surrounding said fusible element;

c. a casing of synthetic-resin-glass-cloth laminate housing said fusible element and said arc-quenching means;

d. a pair of terminal elements arranged on the ends of, and supported by, said casing and conductively interconnected by said fusible element;

e. said casing including a first ply formed of glass fiber mat material having non-uniformly oriented fibers, said casing further including a second and a third ply arranged on opposite sides of said first ply and sandwiching said first ply, said second ply and said third ply each being of woven glass fiber fabric and each said second and said third ply forming an overlap extending in a direction longitudinally of said casing, said overlap of said second ply and said overlap of said third ply being angularly displaced relative to each other;

f. said casing further including a thermosetting resin integrating said first ply, said second ply and said third ply into a laminate; and g. the glass fiber density of said laminate being locally increased at the region of said overlap of said second ply and at the region of said overlap of said third ply to such an extent that the wall thickness of said casing is virtually uniform along the entire periphery thereof.

2. A fuse as specified in claim 1 wherein said mat material is formed by substantially random oriented glass fibers.

3. An electric fuse as specified in claim 1 wherein said overlap of said second ply and said overlap of said third ply are angularly displaced about 180°.

4. An electric fuse as specified in claim 1 wherein said first ply forms an overlap extending in a direction longitudinally of said casing and being angularly displaced relative to said overlap of said second ply and said overlap of said third ply.

5. An electric fuse as specified in claim 1 including an additional layer of glass fiber mat material having non-uniformly oriented fibers, said additional layer being substantially coextensive with the ply of woven glass fiber fabric forming the inner surface of said casing, and said additional layer forming an overlap substantially coextensive with the overlap formed by the ply of woven glass fiber fabric forming the inner surface of said casing.

6. An electric fuse including a. a fusible element;

b. a pulverulent arc-quenching filler surrounding said fusible element;

c. a cylindrical casing of synthetic-resin-glass-cloth laminate housing said fusible element and said filler;

d. a pair of terminal elements arranged on the ends of, and supported by, said casing and conductively interconnected by said fusible element; and e. said casing including an intermediate ply of non-woven glass fiber mat material sandwich between a pair of plies of woven glass fiber fabric, each of said pair of plies having a circumferential extent in excess of 360° and each overlapping along an area extending in a direction longitudinally of said casing, said overlapping area of one of said pair of plies being angularly displaced relative to said overlapping area of the other of said pair of plies;

f. said casing further including a thermosetting resin integrating said intermediate ply and said pair of plies into a laminate; and g. the glass fiber density of said laminate being locally increased at the regions of said overlap of each of said pairs of plies to such an extent that the non-overlapping area and the overlapping area of the radially outer of said pair of plies define a first cylindrical surface, and the non-overlapping area and the overlapping area of the radially inner of said pair of plies define a second cylindrical surface arranged in coaxial relation to, and spaced equidistantly from, said first cylindrical surface.

7. An electric fuse as specified in claim 6 wherein said intermediate ply of non-woven glass fiber mat material has a circumferential extent in excess of 360° and overlaps along an area extending in a direction longitudinally of said casing, the overlapping area of said intermediate ply being angularly displaced relative to said overlapping area of each of the other of said pair of plies.

8. An electric fuse as specified in claim 7 wherein said overlapping area of said intermediate ply and said overlapping area of each of said pair of plies are angularly displaced about 120°.

9. An electric fuse as specified in claim 7 wherein said intermediate ply is formed by a plurality of superimposed layers each having a circumferential extent in excess of 360° and each overlapping along an area extending in a direction substantially longitudinally of said casing, said overlapping area of each of said plurality of layers being angularly displaced relative to each other.

10. An electric fuse comprising a. a fusible element;

b. an arc-quenching material surrounding said fusible element;

c. a casing of synthetic-resin-glass-cloth laminate housing said fusible element and said arc-quenching material;

d. a pair of terminal elements arranged at the ends of, and supported by said casing, and conductively interconnected by said fusible element; and e. said casing including an innermost ply and an outermost ply of woven glass fiber fabric each having a circumferential extent in excess of 360° and each overlapping along an area extending in a direction longitudinally of said casing, said casing further having a plurality of intermediate plies of glass fiber mat material having non-uniformly oriented fibers, and said casing including an additional intermediate ply of spaced glass fiber rovings extending in a direction longitudinally of said casing;

f. said casing further including a thermosetting resin integrating said innermost ply, said outermost ply, said plurality of intermediate plies and said additional intermediate ply of glass fiber rovings into a laminate; and g. the glass fiber density of said laminate being locally increased at least at said overlapping area of said innermost ply and said outermost ply to such an extent that the wall thickness of said casing is virtually uniform along the entire periphery thereof.

11. A fuse as specified in claim 10 wherein said glass fiber mat material is a non-woven fabric having substantially random oriented fibers, and wherein at least some of said intermediate plies have a circumferential extent in excess of 360° and form angularly displaced overlaps extending in a direction longitudinally of said casing.

12. A fuse as specified in claim 10 wherein at least a first ply of glass fiber mat material is interposed between said outermost ply and said additional ply of glass fiber rovings, and wherein at least a second ply of glass fiber mat material is interposed between said innermost ply and said additional ply of glass fiber rovings.

13. A fuse as specified in claim 12 wherein said first ply of glass fiber mat material and said second ply of glass fiber mat material each have a circumferential extent in excess of 360°, each overlapping along an area extending in a direction longitudinally of said casing, and wherein said overlapping area of said first ply of glass fiber mat material and said overlapping area of said second ply of glass fiber mat material are angularly displaced relative to each other.

14. An electric fuse as specified in claim 10 wherein said innermost ply of said casing has a liner layer on the inside thereof of non-woven glass fiber mat having non-uniformly oriented fibers, said liner layer being substantially coextensive with said innermost ply and said liner-layer overlapping at an area substantially coextensive with the area of overlap of said innermost ply.

15. An electric fuse as specified in claim 10 wherein said innermost ply of said casing and said outermost ply of said casing each has a liner layer on the inside thereof of a non-woven glass fiber mat having non-uniformly oriented fibers, said liner layer of said innermost ply being substantially coextensive with said innermost ply, and said lining layer of said outermost ply being substantially coextensive with said outermost ply, said liner layer of said innermost ply overlaping at an area substantially coextensive with the area of overlap of said innermost ply, and said liner layer of said outermost ply overlapping at an area substantially coextensive with the area of overlap of said outermost ply.

16. An electric fuse comprising a. a fusible element;

b. a pulverulent arc-quenching filler surround said fusible element;

c. a casing of synthetic-resin-glass-cloth laminate housing said fusible element and said filler;

d. a pair of terminal elements arranged at the ends of, and supported by, said casing and conductively interconnected by said fusible element; and e. said casing including an innermost ply and an outermost ply of woven glass fiber fabric each having a circumferential extent in excess of 360° and overlapping along an area extending in a direction longitudinally of said casing, said overlapping area of said innermost ply and said overlapping area of said outermost ply being angularly displaced relative to each other, said casing further including a ply formed by spaced glass fiber rovings extending in a direction longitudinally of said casing, said casing further including glass fiber mat plies having non-uniformly oriented fibers interposed between said outermost ply and said ply of said glass fiber rovings and interposed between said innermost ply and said ply of glass fiber rovings;

f. said casing further including a thermosetting resin integrating said innermost ply, said outermost ply, said ply formed by glass fiber rovings and glass fiber mat plies into a laminate; and g. said innermost ply, said outermost ply, said ply of glass fiber rovings and said glass fiber mat plies being radially compressed to such an extent that the wall thickness of said casing is virtually uniform along the entire periphery thereof.

17. A fuse as specified in claim 16 wherein said glass fiber plies are formed by non-woven materials having substantially random oriented fibers, and wherein the density of the fibrous content of said casing is locally increased at each overlapping area of the constituent plies thereof.

18. An electric fuse comprising:

a. fusible element means;

b. an arc-quenching material surrounding said fusible element means;

c. a casing of synthetic-resin-glass-cloth laminate housing said fusible element means and said arc-quenching material;

d. a pair of terminal elements arranged at the ends of, and supported by, said casing and conductively interconnected by said fusible element means; and e. said casing including a pair of plies of woven glass fiber fabric of which one plie is the outermost ply and the other ply is the innermost ply of said casing and said casing further including a plurality of plies of glass fiber mat having non-uniformly oriented fibers sandwiched between said outermost ply and said innermost ply, said outermost ply, said innermost ply and some of said plurality of plies having a circumferential extent in excess of 360° and overlapping along areas extending in a direction longitudinally of said casing, some of said overlapping areas of some of said plurality of plies being angularly displaced relative to said overlapping areas of said one of said pair of plies;

f. a thermosetting resin integrating said pair of plies and said plurality of plies into a laminate; and g. said overlapping areas of outermost ply and of said innermost ply being compressed and radially displaced into said plurality of plies to such an extent that the wall thickness of said casing is virtually uniform along the entire periphery thereof.

19. An electric fuse as specified in claim 18 including a ply formed by spaced glass fiber rovings extending in a direction longitudinally of said casing, said ply formed by said rovings being arranged inbetween a pair of said plurality of plies of glass fiber mat.

20. A synthetic resin laminate tubing having a high bursting strength including:

a. a first ply formed by substantially random oriented glass fibers;

b. a second ply and a third ply arranged on opposite sides of said first ply and sandwiching said first ply, said second ply and said third ply being of woven glass fiber fabric and said second ply and said third ply each having a periphery extent exceeding 360° and each forming an area of overlap extending in a direction longitudinally of said tubing, said area of overlap of said second ply and of said third ply being angularly displaced;

c. said tubing further including a thermosetting resin integrating said first ply, said second ply and said third ply into a laminate; and d. the glass fiber density of said laminate being locally increased at said area of overlap of said second ply and at said area of overlap of said third ply to such an extent that the wall thickness of said tubing is virtually uniform along the entire perimeter thereof.

21. A synthetic resin laminate tubing having a high bursting strength comprising:

a. a pair of plies of woven glass fiber fabric including an outermost ply and an innermost ply;

b. a plurality of plies of glass fiber mat having non-uniformly oriented fibers sandwiched between said outermost ply and said innermost ply;

c. said outermost ply, said innermost ply and some of said plurality of plies of glass fiber mat having a circumferential extent in excess of 360° and overlapping along areas extending in a direction longitudinally of said casing, some of said overlapping areas of some of said plurality of plies being angularly displaced relative to the overlapping area of one of said pair of plies;

d. a thermosetting resin integrating said pair of plies and said plurality of plies into a laminate; and e. said overlapping areas of said pair of plies and said overlapping area of some of said plurality of plies forming regions where the density of glass fibers is increased to such an extent that the wall thickness of said laminate is virtually uniform along the entire periphery thereof.

22. A synthetic resin laminate tubing as specified in claim 21 including an additional ply formed by spaced glass fiber rovings extending in a direction longitudinally of said tubing, arranged to form a squirrel-cage-like structure and positioned between a pair of said plurality of plies of glass fiber mat.

* * * * *

REEXAMINATION CERTIFICATE (768th)

United States Patent [19]

Healey, Jr.

[11] B1 3,979,709

[45] Certificate Issued Oct. 13, 1987

[54] ELECTRIC FUSE HAVING A MULTIPLY CASING OF A SYNTHETIC-RESIN GLASS-CLOTH LAMINATE

[75] Inventor: Daniel P. Healey, Jr., Merrimacport, Mass.

[73] Assignee: The Chase-Shawmut Company, Newburyport, Mass.

Reexamination Reqs:st:
No. 90/001,116, Oct. 20, 1986
No. 90/001,145, Dec. 19, 1986

Reexamination Certificate for:

| | |
|---|---|
| Patent No.: | **3,979,709** |
| Issued: | **Sep. 7, 1976** |
| Appl. No.: | **579,972** |
| Filed: | **May 22, 1975** |

Disclaimer of claim 1-22 filed: Jan. 28, 1987 (1081 O.G. 35)

[51] Int. Cl.[4] ..... H01H 85/02; H01H 37/02

[52] U.S. Cl. ..... 337/186; 337/414; 337/415

[58] Field of Search ..... 337/158, 186, 414, 415

[56] References Cited

U.S. PATENT DOCUMENTS

| | | | |
|---|---|---|---|
| 961,175 | 6/1910 | Smith . | |
| 2,727,961 | 12/1955 | Smith, Jr. | 200/131 |
| 2,929,900 | 3/1960 | White | 200/131 |
| 3,235,429 | 1/1962 | Boggs | 156/166 |
| 3,855,031 | 12/1974 | McNeely | 156/190 |
| 3,979,709 | 9/1976 | Healey, Jr. | 337/186 |

OTHER PUBLICATIONS

John Comey, Designing Thermoset Shapes For Pultrusion, 12/23/71, The Glastic Corporation.

*Primary Examiner*—George Harris

[57] ABSTRACT

An electric fuse comprises a fusible element, arc-quenching means surrounding said fusible element, a casing of synthetic-resin-glass-cloth laminate housing said fusible element and said arc-quenching means, and a pair of terminal elements arranged at the ends of said casing and conductively interconnected by said fusible element. Said casing includes a plurality of plies, at least an outermost ply and an innermost ply, both formed by woven glass fiber fabric and at least one intermediate ply formed by a glass fiber mat having non-uniformly oriented fibers. The outermost ply and the innermost ply each form an overlap extending substantially in a direction longitudinally of said casing. Both overlaps are angularly displaced. The casing further includes a thermosetting resin integrating said outermost ply, said innermost ply and said intermediate ply into a laminate. The glass fiber density of said laminate is locally increased at the region of said overlap of said innermost ply, and at the region of said overlap of said innermost ply, to such an extent that the wall thickness of said casing is virtually uniform along the entire periphery or perimeter thereof.

Further disclosed are modifications of the above tubular casing structure having a larger number of plies than three.

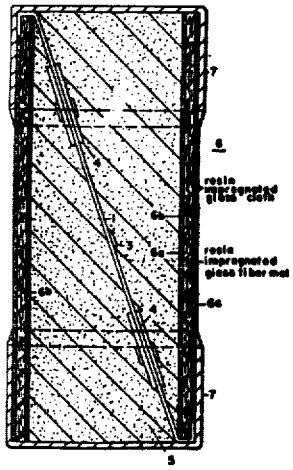

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–22 are now disclaimed.

* * * * *